US006029436A

United States Patent [19]

Stahlecker

[11] Patent Number: 6,029,436

[45] Date of Patent: Feb. 29, 2000

[54] ROTOR CUP FOR OPEN-END SPINNING AGGREGATES AND METHOD OF MAKING SAME

[75] Inventor: Gerd Stahlecker, Eislingen/Fils, Germany

[73] Assignees: Fritz Stahlecker; Hans Stahlecker, both of Germany

[21] Appl. No.: 09/134,380

[22] Filed: Aug. 14, 1998

[30] Foreign Application Priority Data

Aug. 27, 1997 [DE] Germany ..... 197 37 332

[51] Int. Cl.[7] ..... D01H 4/00

[52] U.S. Cl. ..... 57/414; 57/416

[58] Field of Search ..... 57/404, 414, 416

[56] References Cited

U.S. PATENT DOCUMENTS

| | | | |
|---|---|---|---|
| 4,193,253 | 3/1980 | Herbert et al. | 57/58.89 |
| 4,358,922 | 11/1982 | Feldstein | 57/401 |
| 4,358,923 | 11/1982 | Feldstein | 57/401 |
| 4,502,273 | 3/1985 | Miyamoto et al. | 57/416 |
| 4,547,407 | 10/1985 | Spencer | 427/367 |
| 4,576,000 | 3/1986 | Griesinger et al. | 57/416 |
| 4,662,170 | 5/1987 | Raasch | 57/416 |
| 4,777,813 | 10/1988 | Hoffmann et al. | 57/416 |
| 4,848,080 | 7/1989 | Hofmann et al. | 57/414 |
| 4,866,927 | 9/1989 | Fetzer et al. | 57/414 |
| 5,718,110 | 2/1998 | Stahlecker | 57/404 |

FOREIGN PATENT DOCUMENTS

| | | |
|---|---|---|
| 4304151 | 8/1994 | Germany . |
| 4305626A1 | 8/1994 | Germany . |
| 1389244 | 4/1975 | United Kingdom . |

*Primary Examiner*—William Stryjewski
*Attorney, Agent, or Firm*—Evenson, McKeown, Edwards & Lenahan, P.L.L.C.

[57] ABSTRACT

In the case of a rotor cup for an open-end spinning aggregate comprising a rough-surfaced fiber collecting groove and a smooth fiber sliding surface it is provided that hard particles are rolled into the fiber collecting groove. The fiber collecting groove is preferably provided with a soft nickel plating before the particles are rolled in, after which the nickel plating is then hardened.

35 Claims, 3 Drawing Sheets

ROTOR CUP FOR OPEN-END SPINNING AGGREGATES AND METHOD OF MAKING SAME

BACKGROUND AND SUMMARY OF THE INVENTION

This application claims the priority of German application 197 37 332.1, filed in Germany on Aug. 27, 1997, the disclosure of which is expressly incorporated by reference herein.

The present invention relates to a rotor cup for open-end spinning aggregates comprising a rough-surface fiber collecting groove relative to the fibers to be spun, the surface of which is provided with hard particles, and also comprising a smooth fiber sliding surface relative to the fibers, which is free of hard particles.

German published patent application 43 05 626 discloses that the fiber collecting groove has a greater friction resistance than the fiber sliding surface. This permits the fibers to slip sufficiently quickly into the fiber collecting groove and still take on the circumferential speed of the rotor at the latest at the fiber collecting groove. The surfaces of the rotor cup are entirely covered with a nickel-diamond plating. The desired roughness in the fiber collecting groove comes about in that individual diamond particles project out from the plating. The fiber sliding surface, in contrast, is subsequently smoothed in that a large proportion of the diamond grains are pulled out, whereby the fiber sliding surface loses the undesired grip effect.

The disadvantage is that first costly diamond particles are applied to the entire surface of the rotor cup, although they are only really required in the fiber collecting groove.

It is an object of the present invention to plate a rotor cup of the above mentioned type in such a way that from the very beginning, diamond particles are applied only where they are actually required.

This object has been achieved in accordance with the present invention in that the hard particles are rolled into the fiber collecting groove.

The hard particles are thus applied not by means of plating the surface of the rotor cup, but by mechanical means, whereby it is irrelevant whether the surface is plated or not. Much fewer hard particles are hereby needed in order that the rotor cup is adapted in the desired way to the spinning process.

Although in the case of the hard particles, corundum, quartz or other particles can be used, diamond grains are preferred. These are not only favorable for the spinning results, but are also favorable with regard to the wear of the fiber collecting groove. Favorable for yarn formation is a grain size of 3 to 4 $\mu$m.

Although it is possible that, for example, emery grains can be rolled onto a steel surface and adhere well, it is especially advantageous when the fiber collecting groove is provided with a soft nickel plating before the grains are rolled in, according to certain preferred embodiments of the invention. For the purpose of the invention, in addition to the fiber collecting groove, the fiber sliding surface and if required the entire surface of the rotor cup is nickel-plated. This achieves on the one hand the desired smoothness of the fiber sliding surface and on the other hand an adequate protection against corrosion. The nickel plating is then hardened by means of heat treatment after the hard particles have been rolled in.

According to certain preferred embodiments, the fiber collecting groove is provided with a further nickel plating after the hard particles have been rolled in and after the hardening process. This further plating can be worn off during operation of the spinning rotor, so that the hard particles come to the surface. Remains of the second nickel plating remain in the spaces between the particles, so that these adhere better and are not so easily loosened from the surface.

It is favorable when the fiber sliding surface has a pitted surface. This can be applied according to certain preferred embodiments in that the hardened first nickel plating can be treated with a gritted roller. A second plating may be applied over the first plating, which second plating adapts to the gritted texture.

The preferred process for treating a rotor cup according to the present invention takes place in that firstly at least the fiber sliding surface and the fiber collecting groove are nickel-plated, in that subsequently hard particles are rolled into the nickel plating of the fiber collecting groove, and in that at least the fiber collecting groove is subsequently nickel-plated again and that the rotor cup is subsequently temper-hardened. The nickel plating, applied before the hard particles are rolled in, should be hardened after the hard particles have been rolled in.

For the purpose of preferred embodiments of the present invention, the fiber collecting groove is brushed over after the hard particles have been rolled in and before a possible subsequent nickel plating. Thus loose material is reliably removed, in particular before a second nickel plating may be applied.

The fiber sliding surface can be treated in the way of a pitted surface at the latest before a subsequent nickel plating. This can occur already on the steel surface. With the aid of such an orange peel structure, the so-called glass pane effect which occurs when the fibers are sliding down into the fiber collecting groove is prevented.

In practice, the fiber collecting groove is treated with a hard, rotating pressure disk after the hard particles to be rolled in have been filled in. The contour of the pressure disk must match the fiber collecting groove, and is designed blade-like with a very small radius. When the particles are being rolled in, very high specific pressures arise, without particular measures being necessary to create the required pressure. The pressure disk may be provided with a miniature tooth structure on its surface.

Other particles may possibly be added to the hard particles to be rolled in, which intensify the merging of the particles with the base.

When the hard particles are rolled in, the rotor cup should be supported from the outside. For this purpose, the outer contour of the rotor cup must have a sufficiently wide supporting surface in the form of a bearing surface.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
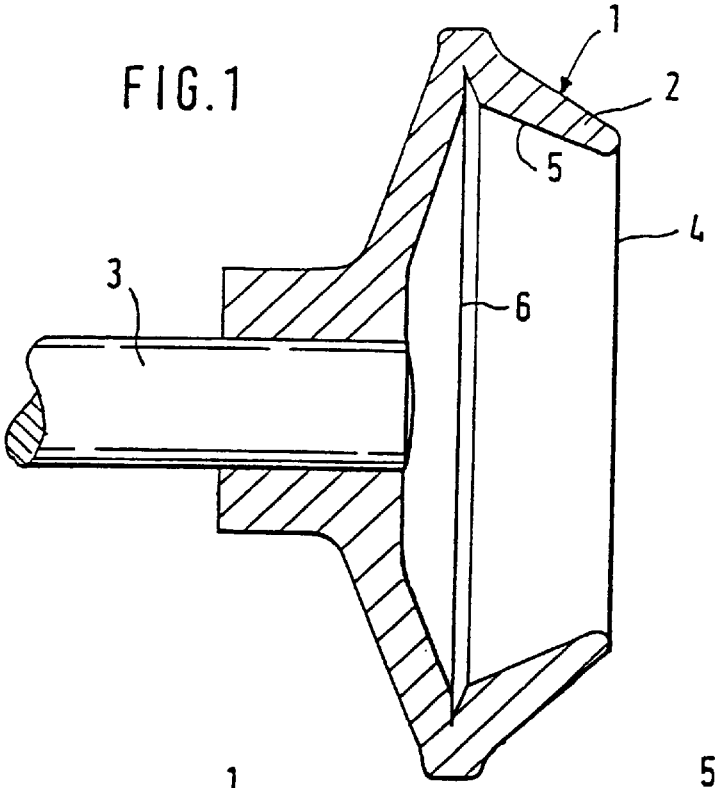
FIG. 1 is an axial sectional through, in comparison to standard embodiments found in practice, an enlarged spinning rotor cup assembly constructed according to preferred embodiments of the present invention.

The spinning rotor 1 shown in FIG. 1 comprises in a known way a rotor cup 2 and a shaft 3 connected thereto. The open front side 4 of the rotor cup 2 faces the service side of the open-end spinning aggregate and is closed during operation by a cover (not shown).

During operation, fibers to be spun are fed through the open front side 4 through a feed channel (not shown) to a fiber sliding surface 5 of the rotor cup 2. On this sliding surface 5 the fibers slide under the action of the centrifugal forces into a fiber collecting groove 6, the diameter of which is at its widest in the inside area of the rotor cup 2.

In order that the fibers reach the fiber collecting groove 6 even in the case of relatively steep fiber sliding surfaces 5, the fiber sliding surface 5 should be designed as smooth as possible. In the fiber collecting groove 6, in contrast, the fibers should take on the circumferential speed of the rotor cup 2 without any slip. For this reason the fiber collecting groove 6 is designed with grip effect relating to the fibers.

The different friction ratios of the fiber sliding surface 5 and the fiber collecting groove 6 are achieved in that the surface of the fiber collecting groove 6 is interspersed with hard particles 7 (see FIG. 2) and the fiber sliding surface 5 is provided with a surface without hard particles.

Figure 2A:
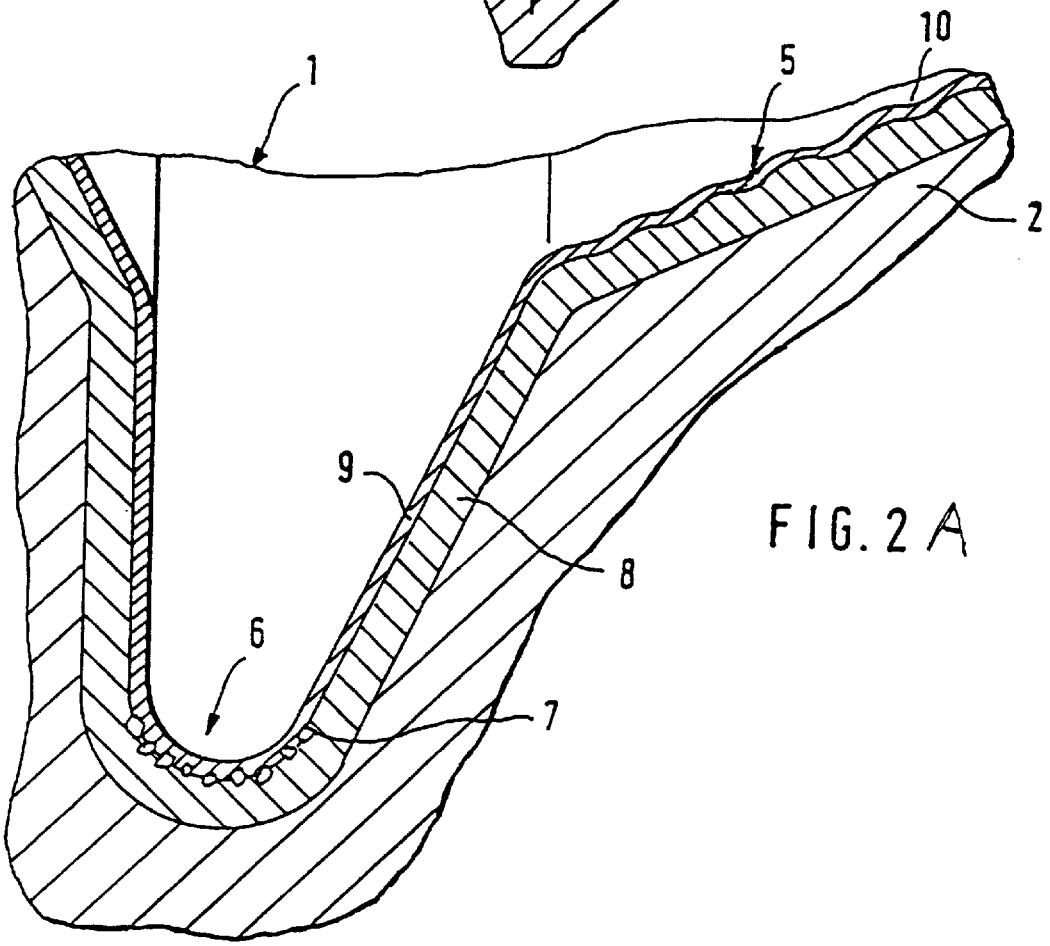
FIG. 2A is a greatly enlarged area of a fiber collecting groove of a rotor cup according to a first embodiment the present invention.

With reference to FIG. 2, the production of the grip effect on the fiber collecting groove 6 is explained below:

The base body of the rotor cup 2 is made of a high-tensile steel, on the surface of which firstly a soft nickel plating 8 is applied, which can extend over the entire interior of the rotor cup 2. This nickel plating 8 has not only from the very beginning the desired smoothness for the fiber sliding surface 5, but also offers a suitable base for rolling the hard particles 7 into the fiber collecting groove 6. The nickel plating 8 should be sufficiently thick in the area of the fiber collecting groove 6.

In a way which is described below, the hard particles 7, for example diamond grains, can be rolled into the nickel plating 8. After the hard particles 7 have been rolled in, the fiber collecting groove 6 should be brushed over, so that loose material not rolled in can be reliably removed. The nickel plating 8 can be subsequently hardened by means of heat treatment. Although not absolutely necessary, it can be practical, after the hard particles 7 have been rolled in, and after the nickel plating 8 has been hardened, to apply a second nickel plating 9 (afterplating), which plating can be significantly thinner. During operation, this second nickel plating 9 can in a short time undergo wear, caused by the yarn, in the fiber collecting groove 6, so that the hard particles 7 reappear on the surface. The second nickel plating 9 helps to prevent the hard particles 7 from coming away too easily from the surface of the fiber collecting groove 6.

Subsequently, after the second plating, a temper hardening takes place.

The fiber sliding surface 5 is advantageously provided with a so-called orange-peel structure 10, which can either be engraved on the surface of the steel straight away or after the application of the first nickel plating 8. It has been proven that such surfaces are practical for the sliding of the fibers.

Figure 3:
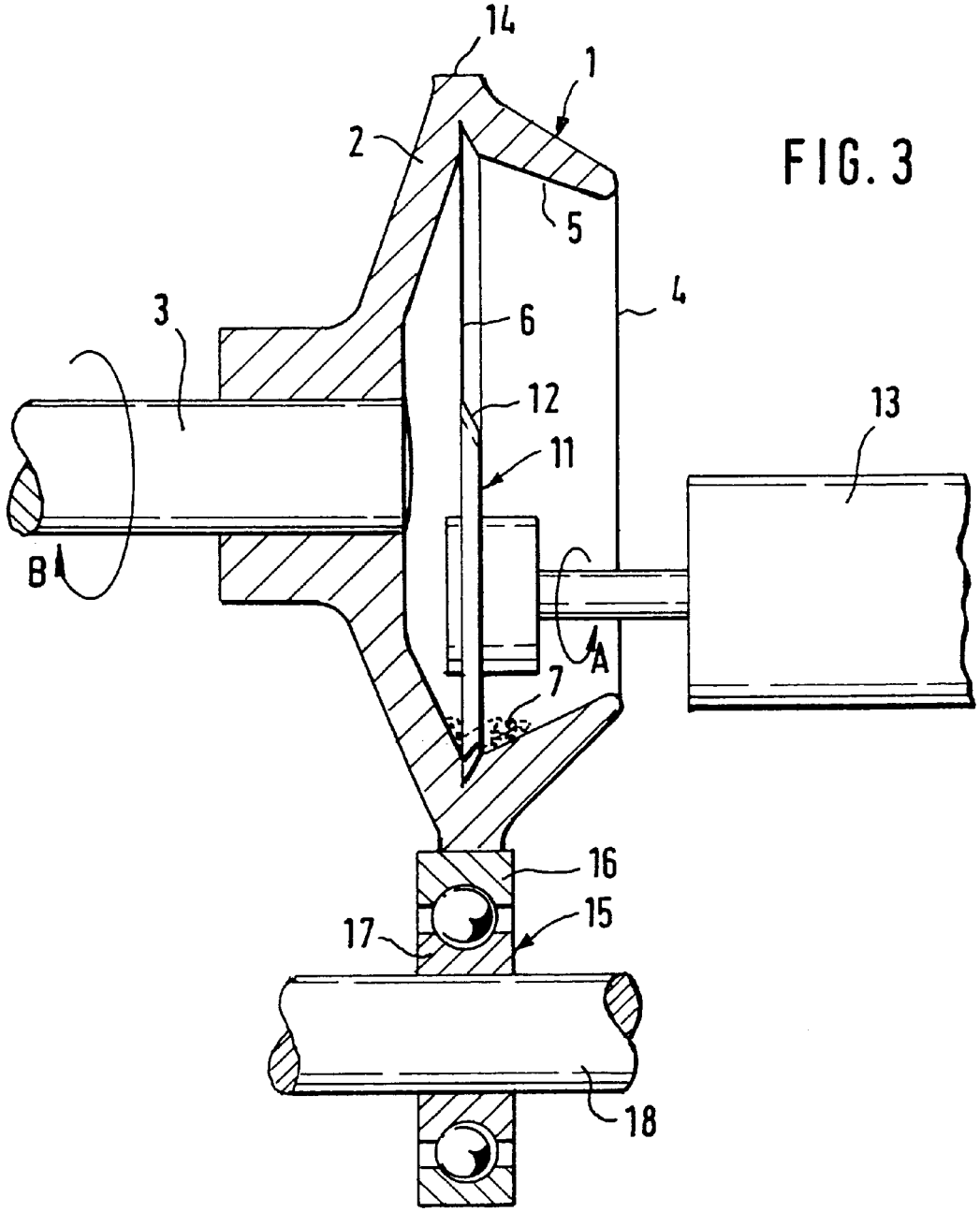
FIG. 3 is a schematic side view showing a device for rolling in the hard particles into the fiber collecting groove according to preferred embodiments of the present invention.

The device for rolling in the hard particles 7 into the fiber collecting groove 6 according to FIG. 3 comprises a pressure disk 11 rotating in direction A, which is adapted to the contour of the fiber collecting groove 6. It comprises thus a cutter 12 with a small radius. The drive motor 13 arranged thereto can be adjusted in axial and radial direction of the rotor cup 1, so that the pressure disk 11 can be precisely positioned at the fiber collecting groove 6 by means not shown.

Due to the cutter with the small radius, a very high specific pressure arises, which rolls the hard particles 7 reliably into the surface of the fiber collecting groove 6. The rest of the particles 7 which are not rolled in are subsequently removed, in particular by means of brushing, from the inside of the rotor cup 2.

In order that the hard particles 7 are evenly distributed over the entire fiber collecting groove 6, the spinning rotor 1 is driven to slow rotations in arrow direction B. The rotor cup 2 comprises a running surface 14 in the form of a supporting surface for taking up the pressure forces, which running surface 14 is supported on a rotating outer ring 16 of a stationary anti-friction bearing 15. The inner ring 17 of the anti-friction bearing 15 is arranged on a stationary axle 18.

Figure 2B:
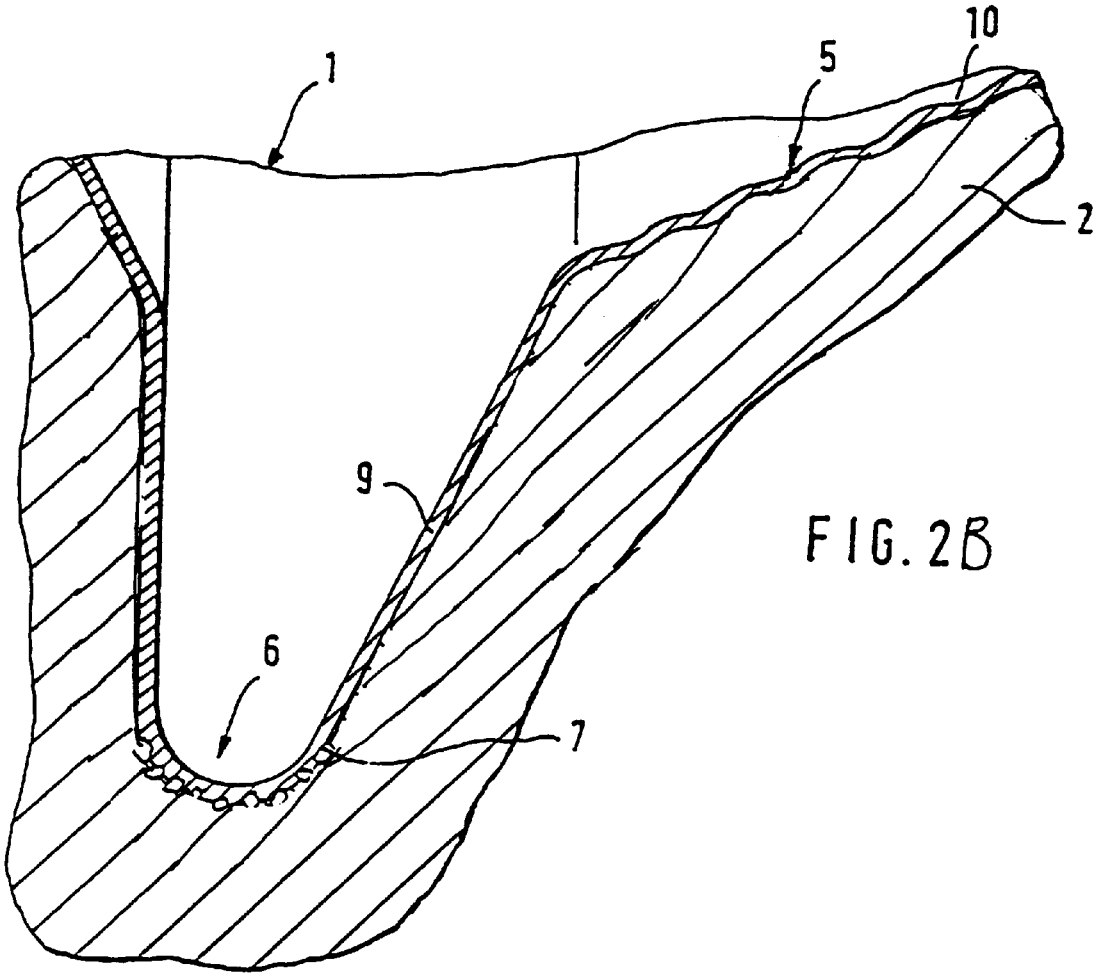
FIG. 2B is a greatly enlarged area of a fiber collecting groove of a rotor cup according to a second embodiment of the present invention.

FIG. 2B depicts a second embodiment which is similar to FIG. 1, except that the first nickel plating 8 is dispensed with and the hard particles 7 are rolled directly into the material of the rotor cup 2.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rotor cup for open-end spinning aggregates comprising:

a fiber collecting groove with grip effect relative to fibers to be spun, the surface of said fiber collecting groove being provided on one of a rotor material forming the rotor cup and a coating material applied to said rotor material with rolled in hard particles, and a fiber sliding surface having a smooth surface relative to the fibers, which fiber sliding surface is free of hard particles and is provided on the same material as said fiber collecting groove.

2. A rotor cup according to claim 1, wherein the hard particles are diamond grains.

3. A rotor cup according to claim 2, wherein the grain size of the hard particles measures 3 to 4 $\mu$m.

4. A rotor cup according to claim 2, wherein the fiber collecting groove is provided with said coating material as a soft nickel plating before the hard particles are rolled in.

5. A rotor cup according to claim 1, wherein the grain size of the hard particles measures 3 to 4 $\mu$m.

6. A rotor cup according to claim 5, wherein the fiber collecting groove is provided with a nickel plating after the hard particles have been rolled in.

7. A rotor cup according to claim 5, wherein the fiber sliding surface comprises an orange-peel structure.

8. A rotor cup according to claim 1, wherein the fiber collecting groove is provided with said coating material as a soft nickel plating before the hard particles are rolled in.

9. A rotor cup according to claim 8, wherein the fiber collecting groove is provided with a nickel plating after the hard particles have been rolled in.

10. A rotor cup according to claim 9, wherein the fiber sliding surface comprises an orange-peel structure.

11. A rotor cup according to claim 8, wherein the fiber sliding surface comprises an orange-peel structure.

12. A rotor cup according to claim 1, wherein the fiber collecting groove is provided with a nickel plating after the hard particles have been rolled in.

13. A rotor cup according to claim 1, wherein the fiber sliding surface comprises an orange-peel structure.

14. A process for treating an open-end spinning rotor cup which has a fiber collecting groove and a fiber sliding surface, comprising:

nickel plating the fiber sliding surface and the fiber collecting groove with a common first nickel plating layer, subsequently rolling hard particles into the nickel plating of the fiber collecting groove while leaving the fiber sliding surface free of hard particles, further nickel plating the fiber collecting groove with a second nickel plating layer, and temper hardening the rotor cup.

15. A process according to claim 14, wherein the first nickel plating layer applied before the hard particles are rolled in is hardened after the hard particle application.

16. A process according to claim 15, wherein the fiber sliding surface is pre-treated to form orange-peel structure surface before the second nickel plating layer is applied.

17. A process according to claim 15, wherein the fiber collecting groove is treated, after the filling in of the hard particles to be rolled in, with a hard, rotating pressure disk.

18. A process according to claim 15, wherein the rotor cup is supported from the outside while the hard particles are rolled in.

19. A process according to claim 14, wherein the fiber collecting groove is brushed over after the hard particles have been rolled in and before the second nickel-plating layer is applied.

20. A process according to claim 15, wherein the fiber collecting groove is brushed over after the hard particles have been rolled in and before the second nickel-plating layer is applied.

21. A process according to claim 19, wherein the fiber sliding surface is pre-treated to form orange-peel structure surface before the second nickel plating layer is applied.

22. A process according to claim 19, wherein the fiber collecting groove is treated, after the filling in of the hard particles to be rolled in, with a hard, rotating pressure disk.

23. A process according to claim 19, wherein the rotor cup is supported from the outside while the hard particles are rolled in.

24. A process according to claim 14, wherein the fiber sliding surface is pre-treated to form orange-peel structure surface before the second nickel plating layer is applied.

25. A process according to claim 24, wherein the fiber collecting groove is treated, after the filling in of the hard particles to be rolled in, with a hard, rotating pressure disk.

26. A process according to claim 24, wherein the rotor cup is supported from the outside while the hard particles are rolled in.

27. A process according to claim 14, wherein the fiber collecting groove is treated, after the filling in of the hard particles to be rolled in, with a hard, rotating pressure disk.

28. A process according to claim 27, wherein the rotor cup is supported from the outside while the hard particles are rolled in.

29. A process according to claim 14, wherein the rotor cup is supported from the outside while the hard particles are rolled in.

30. A process of making an open-end spinning rotor cup which has:

a fiber collecting groove with grip effect relative to fibers to be spun, the surface of said fiber collecting groove being provided on one of a rotor material forming the rotor cup and a coating material applied to said rotor material, and a fiber sliding surface having a smooth surface relative to the fibers, said method comprising:

forming the fiber collecting groove surface and the fiber sliding surface of the same material comprising one of the rotor material and the coating material, applying the coating material to said rotor material, and rolling in hard particles on said fiber collecting groove surface while leaving said fiber sliding surface free of hard particles.

31. A process according to claim 30, wherein during said rolling step said material of said fiber collecting groove surface is uncoated rotor cup material.

32. A process according to claim 31, comprising providing a nickel plating layer over the collecting groove surface with rolled in hardened particles.

33. A process according to claim 30, wherein said coating material is a nickel plating layer.

34. A process according to claim 30, wherein said coating comprises nickel coating the fiber collecting surface and the fiber sliding surface with a common nickel plating layer before said rolling in of hard particles in said fiber collecting surface.

35. A process according to claim 34, comprising providing a second nickel plating layer over the fiber collecting surface with the rolled in hardened particles.

* * * * *